US005139387A

United States Patent [19]

Boldrini et al.

[11] Patent Number: 5,139,387

[45] Date of Patent: Aug. 18, 1992

[54] APPARATUS FOR FEEDING PACKAGING MACHINES WITH STACKS OF SHEET MATERIAL

[75] Inventors: Fulvio Boldrini, Ferrara; Antonio Gamberini, Bologna, both of Italy

[73] Assignee: G.D. S.p.A., Bologna, Italy

[21] Appl. No.: 575,778

[22] Filed: Aug. 31, 1990

[30] Foreign Application Priority Data

Sep. 5, 1989 [IT] Italy ..... 3606 A/89
Jul. 19, 1990 [IT] Italy ..... 3607 A/90

[51] Int. Cl.[5] ..... B65G 59/02

[52] U.S. Cl. ..... 414/795.8; 414/796; 414/796.8; 414/929; 414/417

[58] Field of Search ..... 414/417, 422, 609, 795.8, 414/795.9, 796, 796.5, 796.8, 796.9, 797, 929, 793.8, 794.7, 795.7, 900

[56] References Cited

U.S. PATENT DOCUMENTS 3,776,405 12/1973 Gade ..... 414/417
4,032,021 6/1977 Mabey et al. ..... 414/609 X
4,109,802 8/1978 Fishwick ..... 414/796.5 X
4,493,599 1/1985 Hartness et al. ..... 414/796.9 X
4,671,723 6/1987 Feldkämper ..... 414/796
4,988,264 1/1991 Winski ..... 414/796
4,993,915 2/1991 Berger et al. ..... 414/796.9

FOREIGN PATENT DOCUMENTS 0360314 3/1990 European Pat. Off. ..... 414/796.9
0363722 4/1990 European Pat. Off. ..... 414/796.9
2840626 2/1980 Fed. Rep. of Germany ..... 414/900
0166229 10/1982 Japan .

*Primary Examiner*—Robert J. Spar
*Assistant Examiner*—James Keenan
*Attorney, Agent, or Firm*—Guido Modiano; Albert Josif

[57] ABSTRACT

An apparatus for feeding packaging machines with stacks of cutouts includes a centering member for supporting members of a plurality of stacks of cutouts, the stacks being arranged mutually side by side so as to form parallel and mutually adjacent rows on the supporting members; a unit for removing and transferring individual rows, provided with a head fitted with pushers which are arranged vertically side by side and are adapted to move a single row of stacks in a horizontal transfer direction; a switching platform which is adapted to cooperate with the pushers so as to receive the row of stacks and allow its transfer to a belt for input to the packaging machine.

12 Claims, 8 Drawing Sheets

FIG. 1
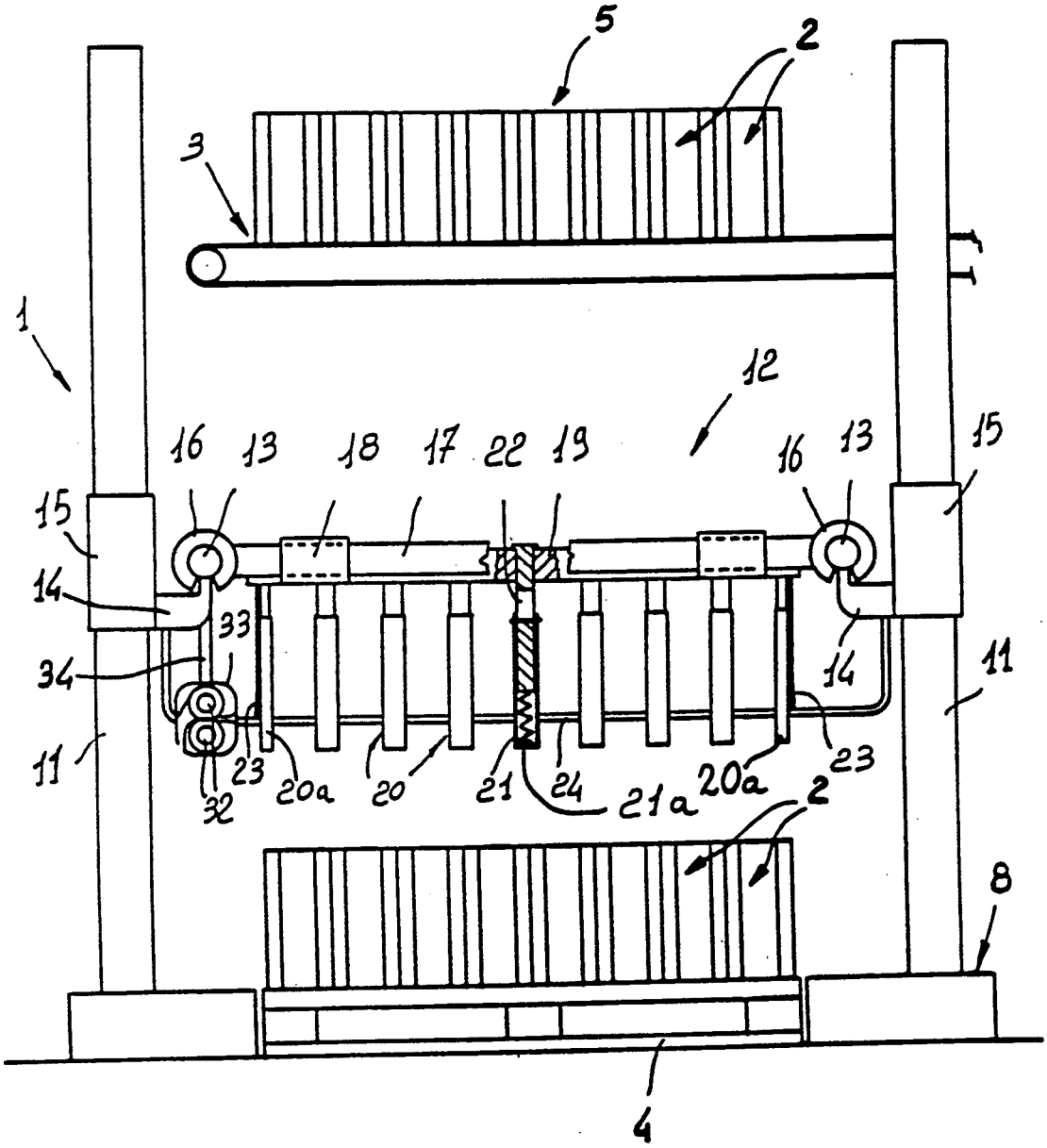
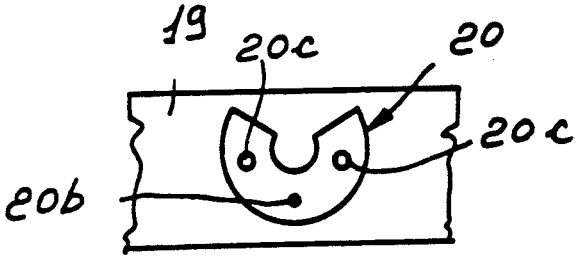
FIG. 8

FIG.6
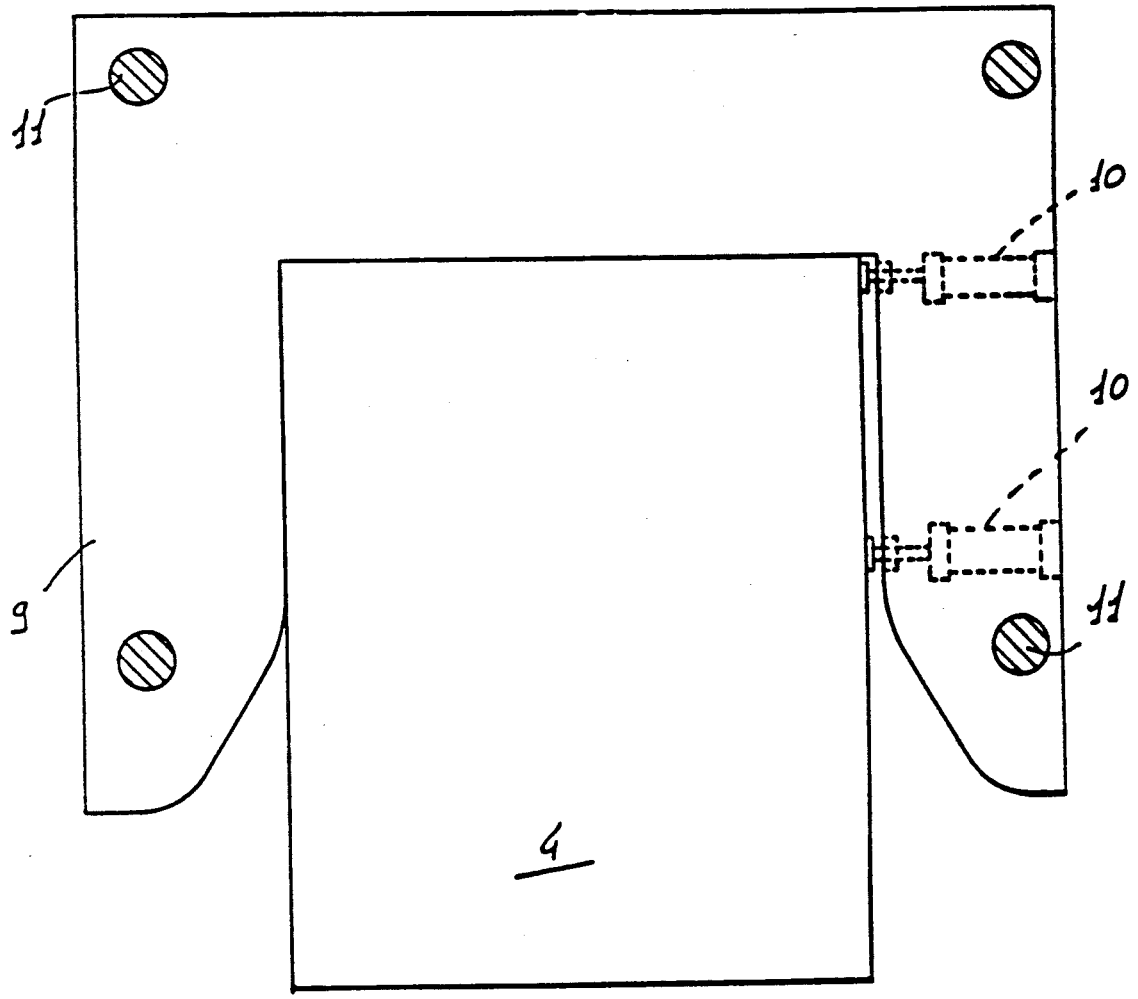
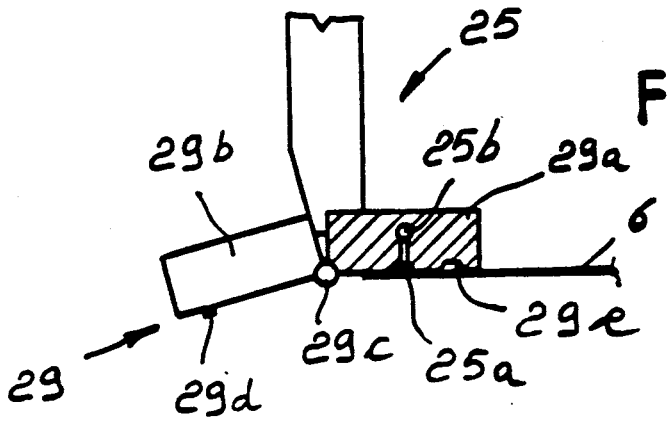
FIG.7

APPARATUS FOR FEEDING PACKAGING MACHINES WITH STACKS OF SHEET MATERIAL

BACKGROUND OF THE INVENTION

The present invention relates to an apparatus for feeding packaging machines with stacks of sheet material.

In particular, the present invention relates to an apparatus for feeding packaging machines with stacks of cutout sheets for cigarette packets.

As is known, cigarette packaging machines are fed with stacks of cardboard cutouts intended to constitute the outer container of the packets. The stacks of cardboard cutouts are arranged on a belt conveyor which advances step by step, so as to convey said stacks to means for transferring the individual cardboard cutouts to a processing line of the machine.

Currently, the stacks of cutouts are manually arranged on the input conveyor of the packaging machine. This considerably reduces the productivity of the machine and entails a considerable cost in labor. The aim of the present invention is to solve the above described problem by means of an apparatus which allows to feed packaging machines with stacks of cardboard cutouts in a fully automatic manner. A further object of the present invention is to provide an apparatus which is simple in concept, absolutely reliable in operation and versatile in use.

SUMMARY OF THE INVENTION

This aim and this object are both achieved by the present apparatus for feeding packaging machines with stacks of sheet material, characterized in that it comprises centering means for supporting means of a plurality of stacks of sheet material or cutouts, said stacks being arranged mutually side by side so as to form on said supporting means mutually adjacent parallel rows; a unit for the removal and transfer of individual rows, provided with a head with pusher means which are arranged vertically side by side and are adapted to move an individual row of stacks in a horizontal transfer direction; a switching platform which is adapted to cooperate with said pusher means so as to receive said row of stacks and allow its transfer to a belt for input to the packaging machine.

BRIEF DESCRIPTION OF THE DRAWINGS

Further feature of the invention will become apparent from the detailed description of a preferred embodiment of the appratus for feeding packaging machines with stacks of sheet material, illustrated only by way of non-limitative example in the acompanying drawings, wherein:

FIG. 1 is a front view of the apparatus for feeding packaging machines;

FIG. 6 is a plan top view of said means for centering the stack supporting platform;

FIG. 7 is a detail view of grip elements of said removal and transfer unit;

FIG. 8 is a detail bottom view of a rod of said head of the removal unit;

DESCRIPTION OF THE PREFERRED EMBODIMENTS

Figure 2:
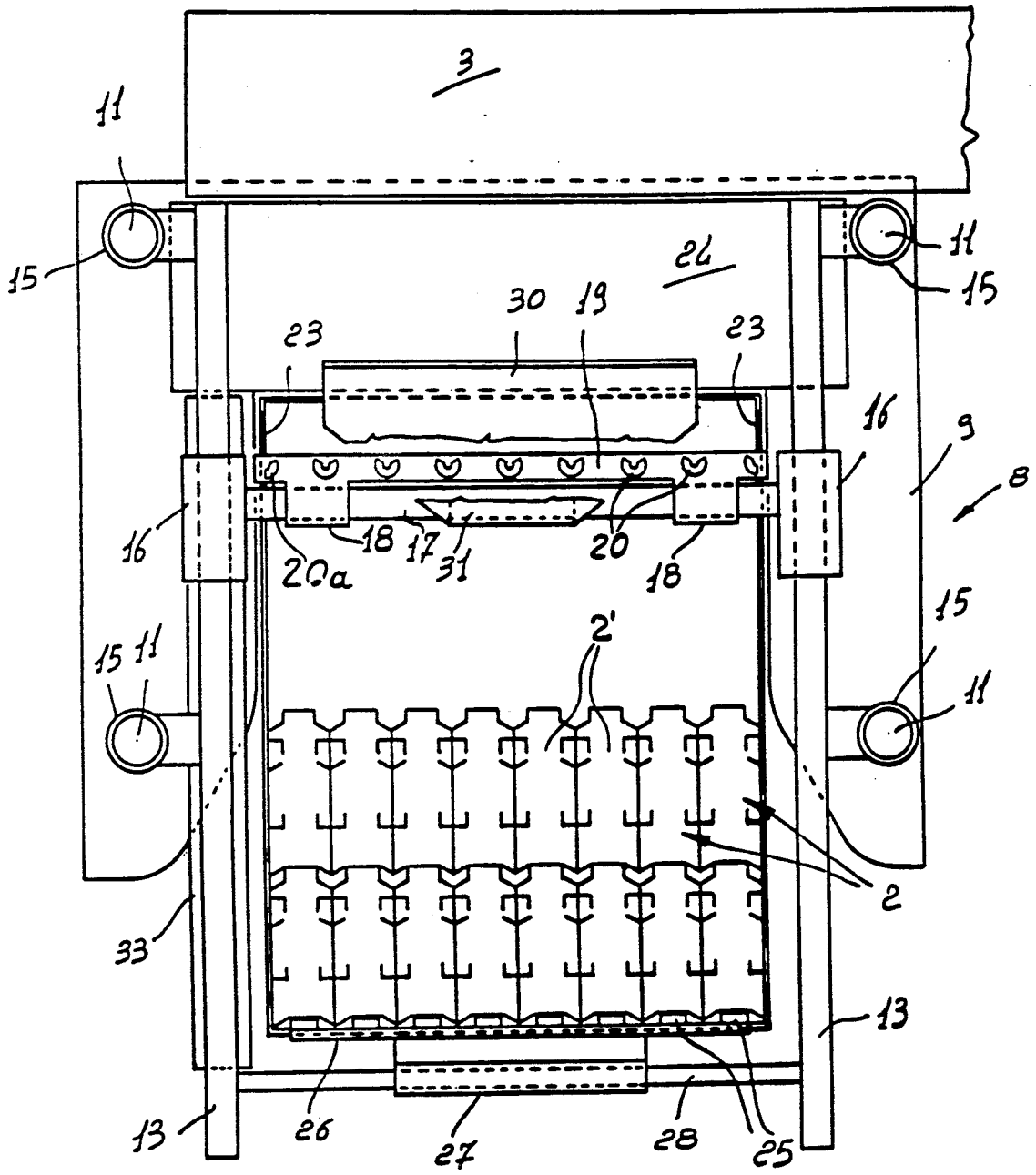
FIG. 2 is a top view thereof.

With particular reference to the above figures, the reference numeral 1 generally indicates an apparatus for automatically feeding stacks 2 of cardboard cutouts 2' to the input belt 3 of a packaging machine, which is not illustrated.

The cardboard cutouts 2' have a substantially rectangular shape which has, at its ends, respectively a tab 2*a* and a trapezoidal indent 2*b*; appropriate folding and cutting lines adapted for the subsequent packaging operations are furthermore defined on the cutouts.

The stacks 2 of cutouts 2' to be transferred to the packaging machine are arranged in an orderly manner on pallet-like supporting means 4. In particular, said stacks 2 are arranged side by side along their longer sides, so as to form parallel rows indicated by 5; said rows 5 are in turn adjacent along the shorter sides of the stacks 2. Said stacks are furthermore arranged so as to form superimposed planes or layers which are separated by paper sheets 6. The paper sheets 6 thus define the supporting platform of the different layers of stacks. It shoudl be noted that respective spaces 7 are defined between the tabs 2*a* and the indents 2*b* of the various rows 5 of stacks and define a sort of V.

The apparatus 1 has a base 8 which defines, on the horizontal plane, a fork-like element 9 suitable for acting as element for centering the pallet 4. A pair of pushers 10 is mounted on a lateral arm of said fork 9 and is adapted to push the pallet 4 into abutment with the opposite arm.

Two pairs of uprights 11 rise symmetrically from the sides of the base 8, and a unit for removing and transferring the stacks 2 of cutouts 2', generally indicated by the reference numeral 12, is vertically movable thereon. Said unit 12 has a pair of beams 13 which are arranged horizontally parallel to the opposite arms of the fork 9 and above them. The beams 13 are supported, by means of related brackets 14, by pairs of sleeves 15 which are respectively slidably mounted on the uprights 11.

The beams 13 slidably support respective sliders 16 which are mutually connected by a cross-member 17. Said cross-member 17 slidably supports, by means of a pair of further sleeves 18, a bar 19 which is parallel thereto and is arranged on the same horizontal plane. Pusher means constituted by a plurality of rods 20 protrudes downward from the bar 19; said rods are orderly arranged side by side and are intended to form a sort of head for the transfer of an entire row 5 of stacks 2. The rods 20 have a circular cross section provided with a V-shaped longitudinal groove so as to be able to penetrate inside respective spaces 7; the rods arranged at the ends of the bar 19, indicated by 20*a*, have a correspondingly halved cross section.

It should be noted that the distance between the axes of athe rods 20 is equal to the width of the cutouts 2'. More in detail, the rods 20 are constituted by a tubular element 21 which is slidably mounted on an inner core 22, and biased downwards by appropriate elastic means 21*a*, bearing against the inner core 22 which is rigidly associated with the bar 19. The rods 20 therefore yield elastically in an axial direction, and are conveniently provided, at their lower end, with respective photocell sensing means 20*b* and with suction means 20*c* (connected to a suction source which is not illustrated) for detecting and eliminating incorrectly arranged cardboard cutouts, as will become apparent in greater detail hereinafter.

The unit 12 has, at the ends of the bar 19, a pair of lateral walls 23 suitable for acting as a guide for the stacks 2 being transferred.

A switching platform 24 is rigidly associated with the removal and transfer unit 12, extends transversely between the beams 13 and is supported by a pair of said brackets 14 in the region comprised between said unit 12 and the input belt 3. The switching platform 24 is vertically movable between the level of the individual supporting platforms 6 of the various layers of stacks 2 and the level of the plane of arrangement of the input belt 3 of the machine to be fed.

The apparatus 1 furthermore has locking means adapted to retain the supporting platform, constituted by the sheet of paper 6, during the transfer of the stacks 2.

Said means are constituted by a plurality of pneumatic and mechanical grip elements 25 which are supported by a further cross-member 26; the cross-member 26 is rigidly associated with a sleeve 27 slidably mounted on a shaft 28. The shaft 28 is transversely supported by the beams 13 at the end which is opposite to the one directed toward the belt 3.

The grip elements 25 comprise an inlet 25*a* which is suitable for being connected to suction means (not illustrated) by means of a duct 25*b* and a clamp 29 which is adapted to grip the edge of the sheet of paper 6. As shown in detail in FIG. 7, the clamp 29 has a fixed jaw 29*a* and a movable jaw 29*b* which is rotatable on a hing 29*c*. The movable jaw 29*b* has grip teeth 29*d* suitable for cooperating with related cavities 29*e* defined in the fixed jaw 29*a*. The fixed jaw 29*a* is furthermore provided with the suction inlet 25*a*. It should be noted that the grip elements 25 are intended to act at the indents 2*b* of the last row 5 of stacks 2, said indents leaving uncovered respective regions of the sheet 6.

Figure 3:
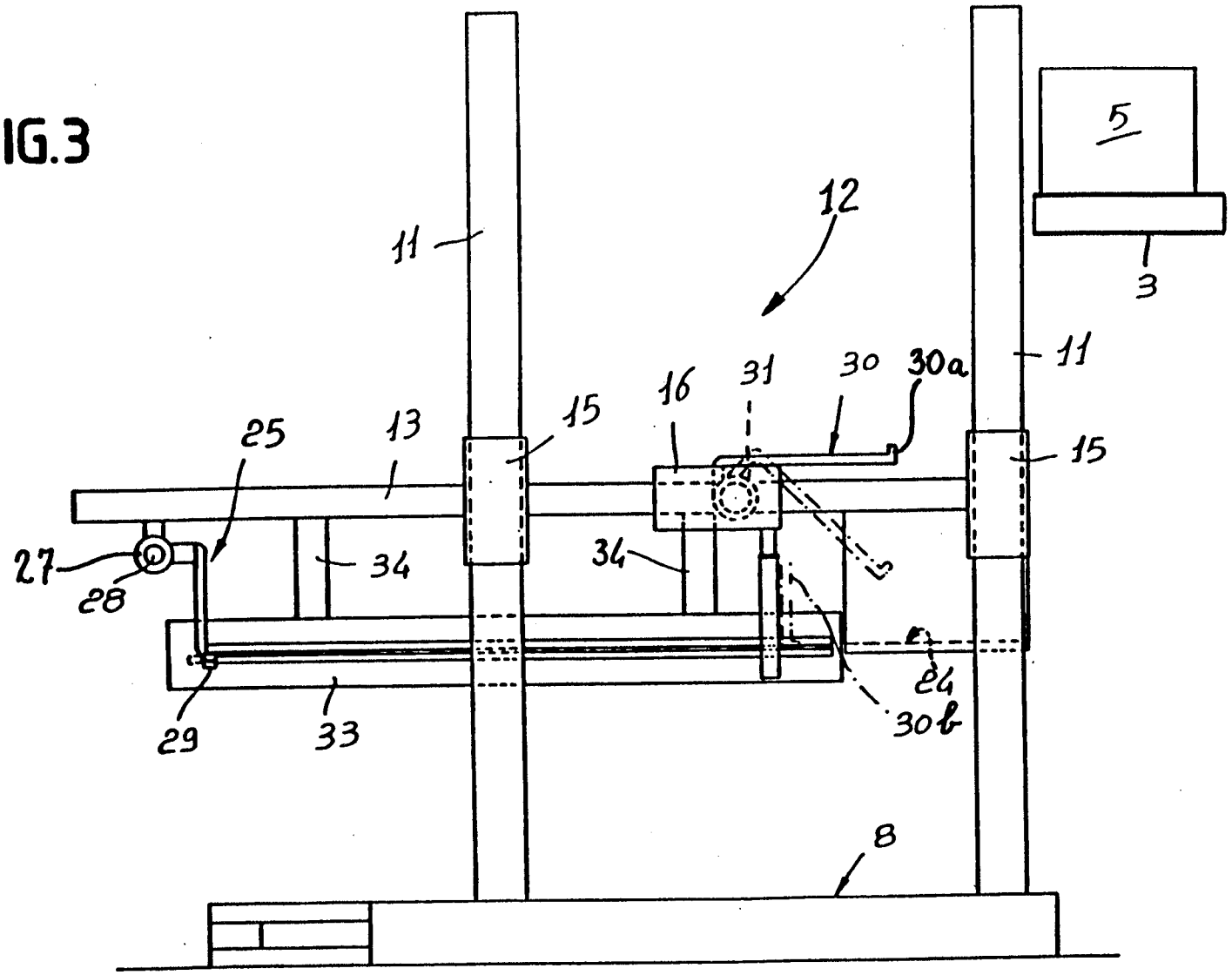
FIG. 3 is a side view thereof.
Figure 4:
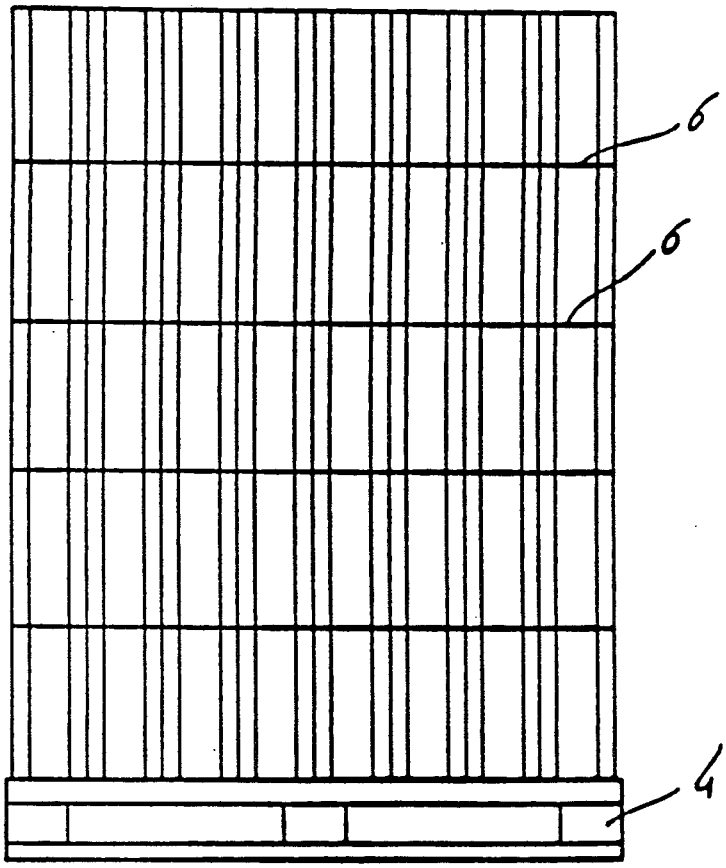
FIGS. 4 and 5 are respectively a side view and a top view of a pallet-like supporting platform which bears said stacks of sheet material.
Figure 5:
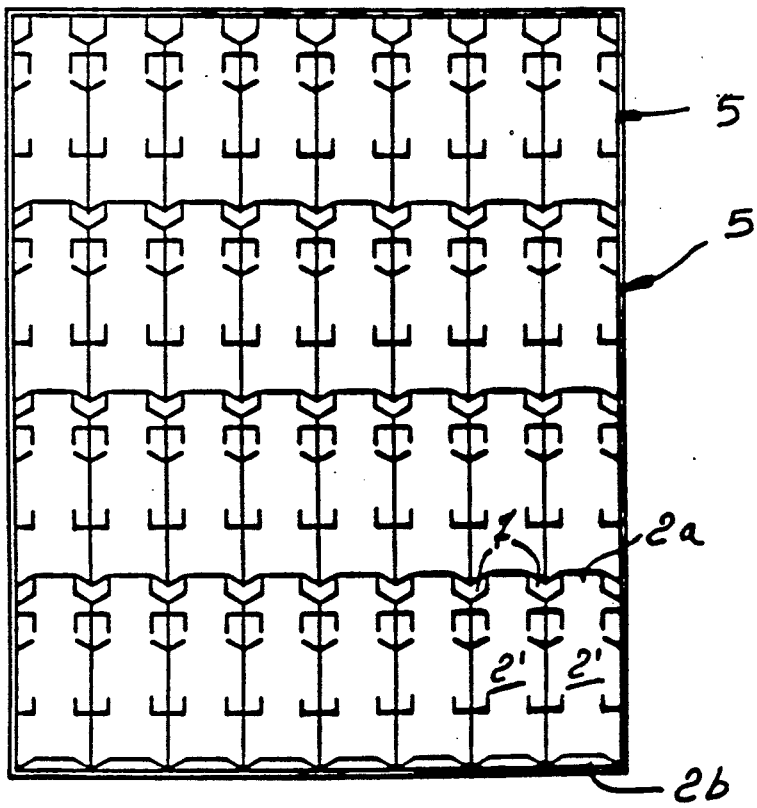

The apparatus 1 is finally provided with a means for eliminating the sheets of paper 6; said means has a further grip element 30 (see FIG. 3) which extends in a cantilevered manner from a sleeve 31 which is mounted so as to be able to rotate and slide axially on the cross-member 17.

Said further grip element 30 has a free end or edge 30*a* suitable for being connected to suction means (not illustrated) similar to those of said grip elements 25.

Said grip element 30 can furthermore oscillate between an idle position, in which it is arranged horizontally so as to not interfere with the transfer operations of the stacks 2, and an operative position, in which it is arranged vertically as illustrated in broken lines 30*b*.

The grip element 25 and 30 are adapted to remove the sheet 6 and to move it laterally to shredding means, constituted by a pair of shredding rollers 32. The framework 33 of the shredding rollers 32 is supported parallel to one of the beams 13 and below it by means of a pair of couplings 34; in practice the shredding rollers operate at the level of the switching platform 24.

The operation of the described apparatus is as follows.

The pallet 4, which supports the stacks 2 to be transferred to the packaging machine arranged in an orderly manner, is inserted in the fork of the base 8, which acts as centering element. The subsequent actuation of the pushers 10 pushes the pallet 4 into the reference position defined by the abutment on the opposite arm of the fork 9.

In this reference position, the pallet 4 is arranged below the removal and transfer unit 12, which is vertically movable on the uprights 11, by means of adapted actuation elements, which are not illustrated. Said unit 12, which is initially in a fully raised position, is lowered so as to insert the rods 20 which form the transfer head inside the respective spaces 7 defined at the sides of the first row 5 of stacks to be transferred.

For this purpose, the rods 20 are moved into alignment with said spaces 7 by moving the sliders 16 along the beams 13 and the bar 19 along the cross-member 17.

The sliders 16 and the bar 19 are actuated by respective actuation means which are not illustrated.

Conveniently, said movements are controlled by an appropriate self-learning control unit (not illustrated) of a known and commercially available type normally used in three-axis measurement machines.

The rods 20 lower until they abut elastically on the sheet of paper 6 which defines the supporting platform of the upper layer of stacks 2.

At this point, the transfer head, constituted by the rods 20, is caused to advance in the direction of the switching platform 24 by virtue of the movement of the sliders 16 on the beams 13, so as to push an entire row 5 of stacks on said switching platform. During said step, the ends of the row 5 of stacks are guided by the lateral walls 23.

During said transfer, the sheet of paper 6 is furthermore retained by the pneumatic and/or mechanical grip elements 25 supported by the cross-member 26. Said cross-member 26 is slidable on the shaft 28, which is transverse with respect to the beams 13, by virtue of the actuation of appropriate actuation means (not illustrated), so as to ensure that said grip elements 26 are arranged at the indents 2*b* of the last row 5 of stacks 2, said indents leaving uncovered respective regions of the sheet 6. In particular, said regions are gripped by the clamps 29, which are actuated by actuation means which are not illustrated.

It should be noted that if one or more of the cutouts 2' at the top of the stacks 2 are incorrectly arranged, the sensor means 20*b* of the rods 20 are capable of sensing the obstruction of the related spaces 7.

Said sensor means 20*b* send an actuation command to the related suction menas 20*c*, which remove the incorrectly arranged cutouts 2', which are subsequently transferred by the unit 12 to appropriate unloading means arranged on the opposite side with respect to the belt 3.

After the transfer of the row 5 onto the switching platform 24, said switching platform is moved to its raised position by virtue of the vertical actuation of the unit 12 with which it is rigidly associated. In said raised position, the switching platform 24 is co-planar to the input belt 3 of the machine to be fed. By means of a subsequent movement of the sliders 16, the row 5 of stacks 2 is thus transferred onto the belt 3.

The removal of the other rows 5 of stacks from the pallet 4 and their transfer onto the belt 3 is subsequently performed in a similar manner. Once the transfer of an entire level or layer of stacks is completed, the sheet of paper 6 is eliminated. For this purpose, the angular rotation of the further grip element 30 into its vertical operating position 30*b* is actuated by virtue of the intervention of actuation elements which are not illustrated.

The sheet of paper is thus removed by suction by the grip elements 25 and 30 and is moved laterally between the shredding rollers 32.

Similarly to what has been described above, the other layers of stacks 2 are subsequently removed and transferred onto the belt 3.

Figure 9:
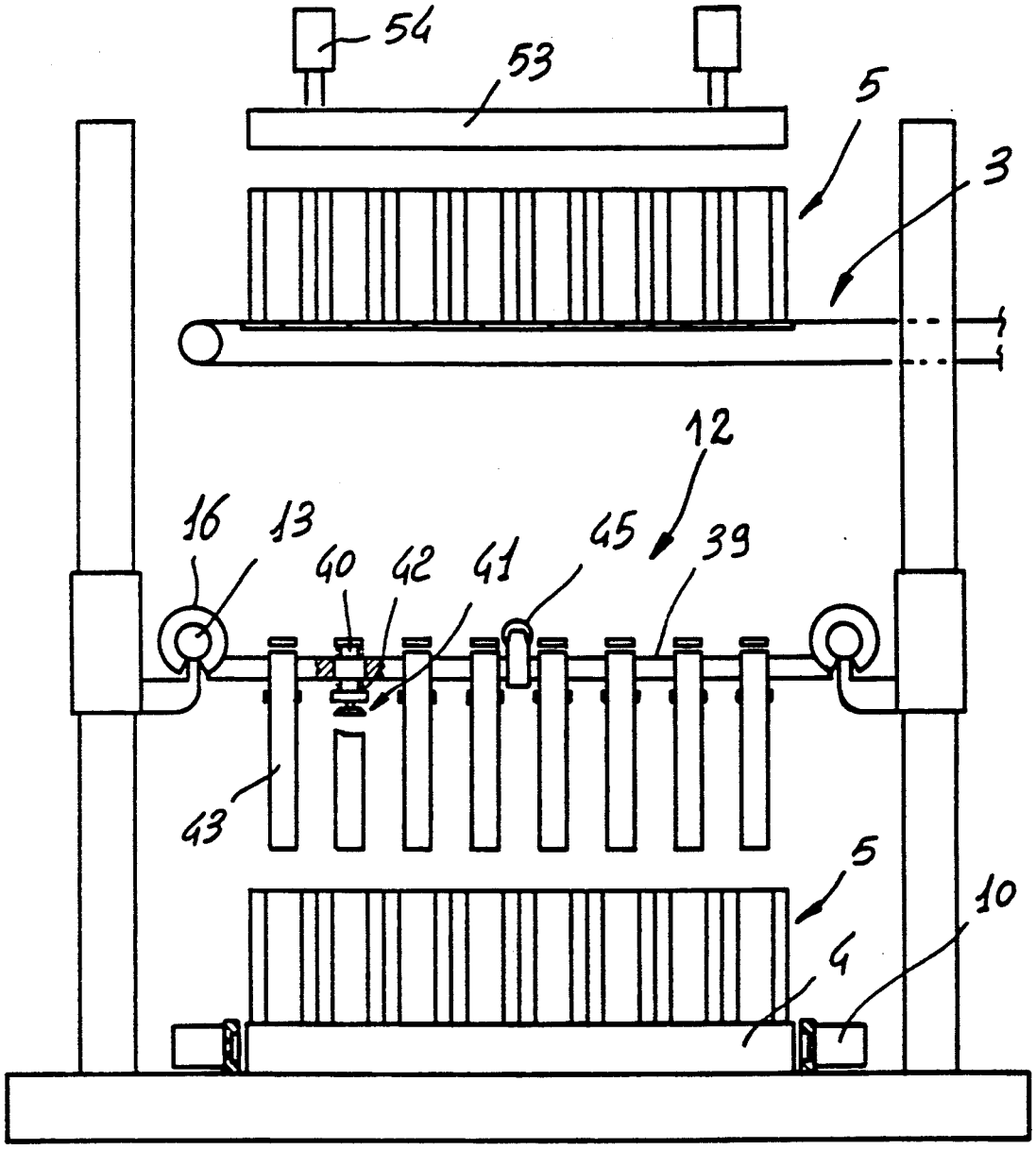
FIG. 9 is a front view of a different embodiment of the invention.
Figure 10:
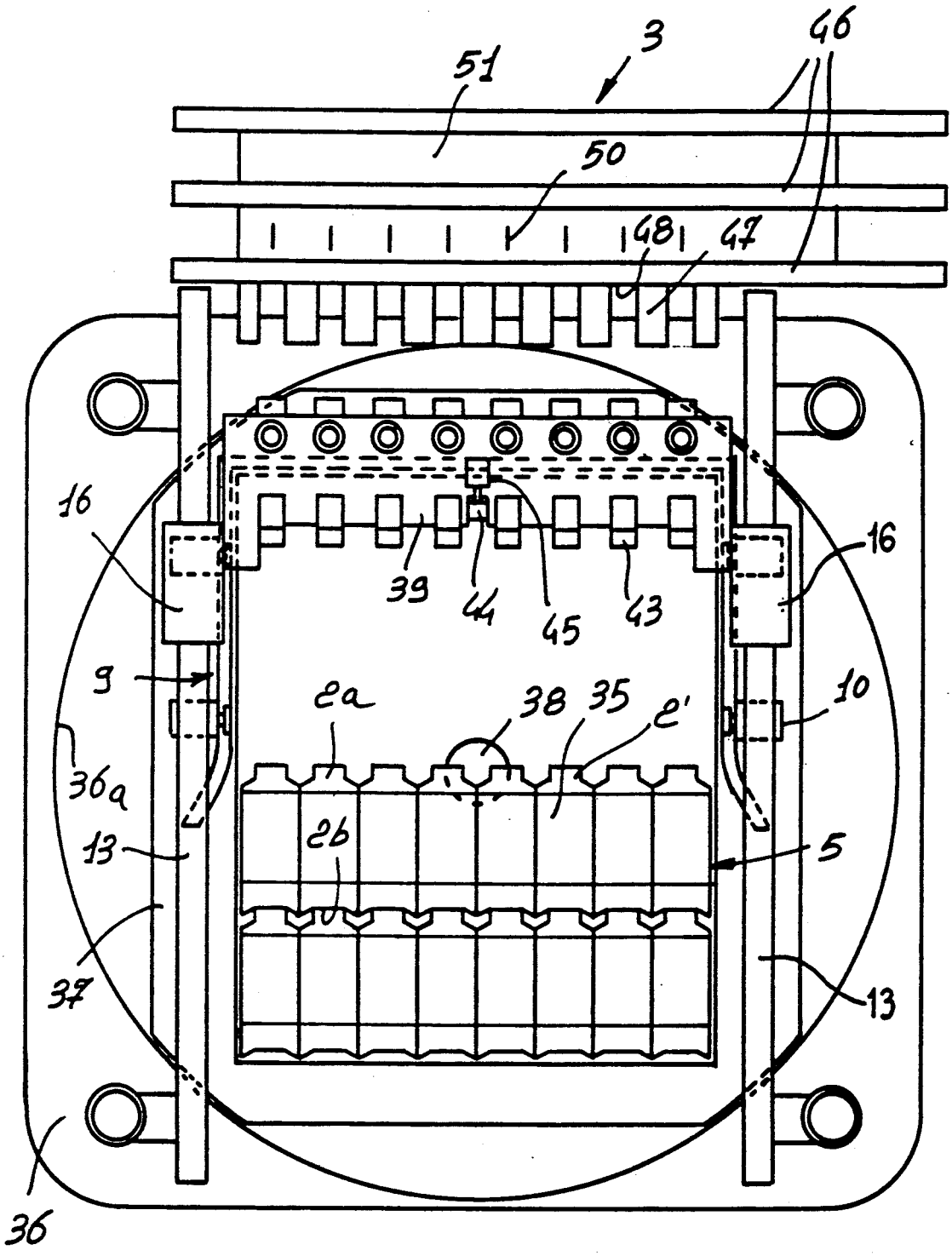
FIGS. 10 and 11 are respectively a top view and a side view of the apparatus of FIG. 9.
Figure 11:
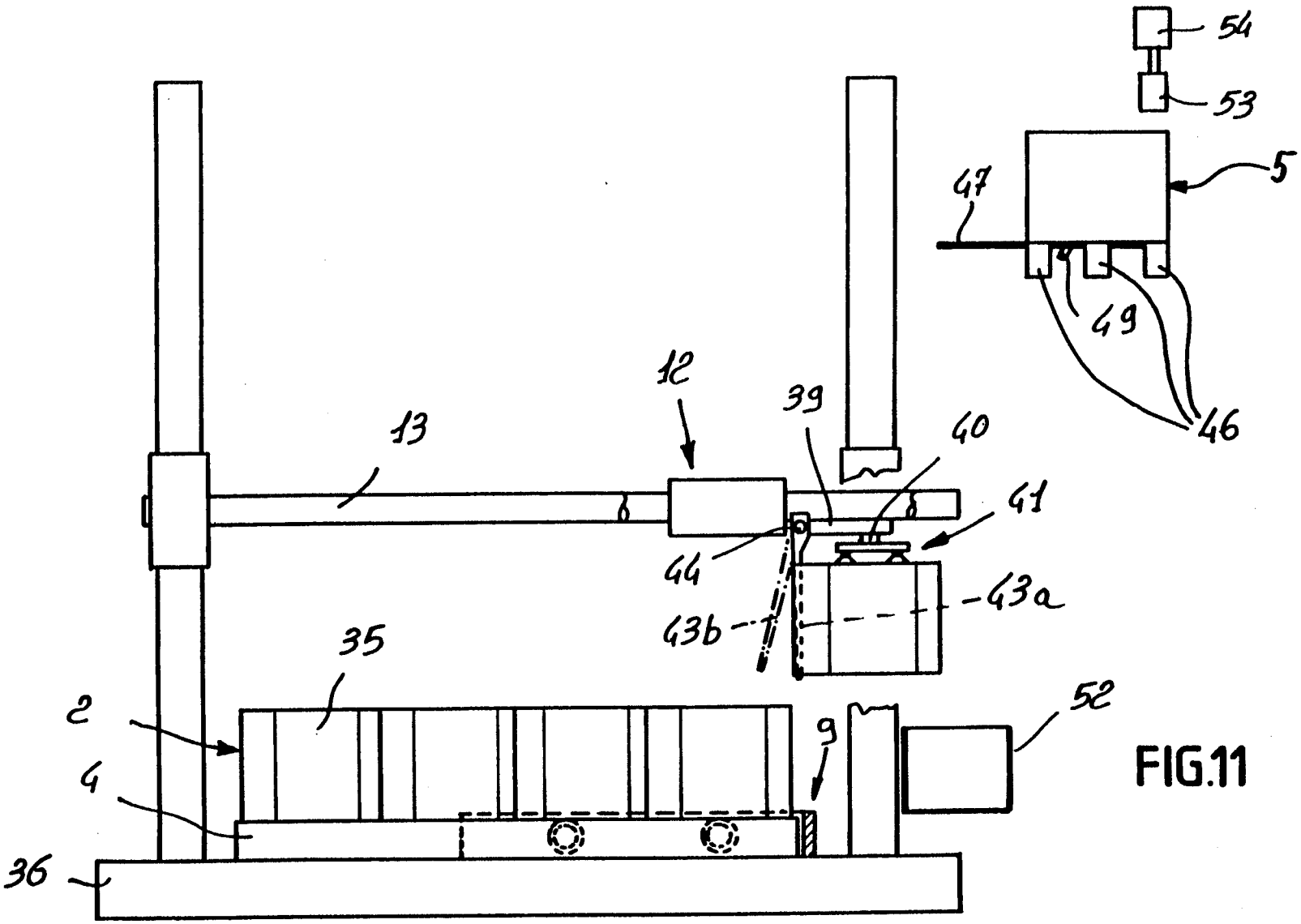

FIGS. 9, 10 and 11 illustrate a different embodiment of the apparatus according to the present invention, which is suitable for feeding the packaging machine with stacks 2 of cutouts 2' which are individually wrapped by respective bands 35. Said 35 are wrapped transversely to the longer sides of the cutouts 2'. The stacks 2 are arranged in an orderly manner so as to form superimposed layers on the pallet 4. Said stacks 2 are preferably arranged side by side along their longer sides, so as to form the parallel rows 5.

In some cases, in order to give greater stability to the various superimposed layers, the stacks 2 are arranged in alternated layers with their longer sides arranged perpendicular, i.e. alternately parallel to the orthogonal sides of the pallet 4.

It may also occur that groups of stacks 2 be arranged along perpendicular directions for a better use of the available space.

The apparatus has a base 36 in which a platform 37 is mounted and is rotatable about a vertical axis 38. The platform 37 has a rectangular shape with rounded corners, and is rotatable in a circular compartment 36*a* of the base 36. The platform 37 has a guide which defines said fork 9 on the horizontal plane; respective parirs of pushers 10 are mounted on the opposite lateral arms of said fork and are intended to center the pallet 4.

It is obviously possible, as in the preceding case, to arrange the pushers 10 on a single lateral arm of the fork 9, so as to push the pallet 4 into abutment with the opposite arm.

By rotating the platform 37 it is possible to prearrange the stacks 2 to be transferred so that the longer sides of the cutouts 2' are directed longitudinally to the beams 13 of the removal and transfer unit, regardless of the orientation of said stacks 2 upon the insertion of the pallet 4.

Said unit 12 has a cross-member 39 which is rigidly associated, at its opposite ends, with the sliders 16 which are slidable on the beams 13. The cross-member 13 vertically slidably supports shafts 40 of respective sucker elements 41 for the removal of the stack 2; the suckers are adapted to be conected to suction means which are not illustrated.

The shafts 40 of the sucker-fitted removal elements 41 are arranged so as to be uniformly distributed side by side. along the cross-member 39; the suckers 41 are suitable for acting at the bands 35 of the stacks 2. The grip elements 41 are elastically supported by means of the interposition of spring means 42 mounted on the shafts 40.

The cross-member 39 furthermore bears pusher means constituted by a plurality of levers 43 which extend radially downward from a shaft 44 which is rotatably supported by the cross-member 39 transversely to the beams 13. The levers 43 are distributed along the shaft 44 respectively at the suction grip elements 41.

The shaft 44 of the lever pushers 43 is actuated by an acutuator 45 which is supported by said cross-member 39. In this manner the levers 43 are actuated in an oscillating manner between a vertical working position and an inclined disengagement position which are respectively indicated by 43*a* and 43*b* (see FIG. 11). It should be noted that in said working position 43*a* the levers 43 engage the trapezoidal indent 2*b* of the cutouts 2'.

The sucker-fitted removal elements 41 are arranged at the side of the cross-member 39 which is directed toward the input belt 3 of the packaging machine, whereas the lever pushers 43 are arranged at the opposite side.

The belt 3 is constituted by a plurality of mutually flanking bands 46, three in the illustrated case. The bands 46 are actuated so as to convey the stacks 2 to a removal compartment which is not illustrated.

A plurality of horizontal strips 47 protrudes transversely to the belt 3 at the upper arm of said belt and extends toward the unit 12 of the apparatus, between the beams 13, so as to define the switching platform for the stacks 2. The strips 47 are uniformly spaced so as to provide, between one and the other, spaces 48 which the lever pushers 43 are suitable for entering.

Means with blades 49 for cutting the bands 35 of the stacks 2 are furthermore arranged between a first pair of said bands 46. Said blades 49 are mounted so as to pass, preferably in an oscillating manner, through respective slot 50 provided in a plane 51 which is substantially co-planar to the upper arm of the bands 46. A container 52 for the cut bands 35 is arranged below the belt 3.

A bar 53 is arranged longitudinally above the belt 3 and is actuated in a vertical direction by means of actuators 54 so as to act on the front end of the cutouts 2', at the tabs 2*a*, during the separation of the bands 35.

The apparatus illustrated in FIGS. 9, 10, 11 operates by inserting and centering the pallet 4 in the fork 9 of the platform 37. If the longer sides of the cutouts 2' of the stacks 2 to be transferred are not directed longitudinally to the beams 13, the angular rotation of the platform 37 on the base 36 is actuated so as to provide said alignment before removal.

The control unit of the apparatus thus actuates the movement of the cross-member 39 of the unit 12 on the first row 5 of stacks 2 to be transferred and the subsequent lowering of said cross-member, so as to move the sucker-fitted removal element 41 to grip the bands 35 of the stacks 2.

The first row 5 to be removed is preferably the one arranged rearward in the upper layer of stacks 2, along the direction of insertion of the pallet 4 between the beams 13. In this manner, the levers 43, which are arranged in the inclined position 43*b* during this step, do not interfere with an adjacent row of stacks.

The stacks 2 are thus removed by suction by the sucker-fitted removal elements 41. The unit 12 conveniently has control means suitable for preventing the grip of the stacks 2 which are not arranged longitudinally to the beams 13 along the row.

The row of removed stacks 2 is raised and transferred onto the strips 47 which constitute the switching platform of the apparatus. The actuator 45 meanwhile actuates the rotation of the lever pushers 43 into the vertical working position 43*a*; the lever pushers 43 engage the rear trapezoidal indents 2*b* of the cutouts 2'.

At this point the transfer head constituted by said levers 43 is advanced in the direction of the input belt 3, so as to push the row of stacks 2 onto the bands 46 of the belt 3, which are co-planar to said switching platform. In this step, the levers 43 insert with their lower end in the spaces 48 of the switching platform.

During the transfer of the stacks 2, the cutting blades 49, which protrude between the bands 46, cut the bands 35 which individually wrap the stacks 2.

The cut bands 35 are removed by the sucker-fitted removal elements 41 before the feeding of the stacks 2 to the packaging machine. The lowering of the bar 53 is actuated for this purpose and retains the cutouts 2' on the belts 46 while the suckers 41 which retain the bands 35 are raised. The removed bands 35 are then deposited in the underlying container 52.

The unit 12 presets itself, at this point, for a subsequent step of removal of a row stacks 2, similarly to what has been described.

The described apparatus allows, in summary, to feed packaging machines with stacks of cardboard cutouts in a fully automatic manner. In particular, the apparatus transfers an entire row of the stacks at a time, providing a high operating speed which is suitable for that of conventional machines, which are capable of packaging approximately 600 packets per minute. In the practical embodiment of the invention, the materials employed, as well as the shapes and dimensions, may be any according to the requirements.

We claim:

1. Apparatus for feeding packaging machines with stacks of sheet material, comprising:

supporting means for a plurality of stacks of sheet material, said stacks being arrangeable thereon, mutually side by side, to form mutually adjacent parallel rows of stacks;

means for centering said supporting means;

a unit for individually removing and transferring said rows of stacks;

a switching platform for receiving said rows of stacks and transferring them;

a belt for inputting said rows of stacks, transferred by said switching platform, to the packaging machine; wherein said unit comprises:

a head with pusher means arranged vertically side by side for moving an individual row of stacks along a horizontal transfer direction, a pair of horizontally parallel and vertically movable beams, said beams slidably supporting respective sliders, said sliders being mutually connected by a cross-member, said cross-member slidably supporting a bar, said bar being parallel to said cross-member, a plurality of rods protruding from said bar, said rods being uniformly distributed and arranged mutually side by side for constituting said head; and wherein said means for centering comprises a base, said base having sides, pairs of uprights rising from sides of said base, said pairs of uprights supporting vertically slideable sleeves, said sleeves supporting said beams.

2. Apparatus according to claim 1, wherein said rods comprise a tubular element whch is slidably mounted on an inner core, said inner core being rigidly associated with said bar, said tubular element being biased downwards by elastic means, said elastic means bearing against said inner core, therefore said rods yielding elastically downwards.

3. Apparatus accordin to claim 1, wherein said means for centering said supporting means comprises a fork-like element, said fork-like element being defined on a horizontal plane by a base, said base having lateral, opposite arms, and wherein at least one of said lateral arms comprises a pair of pushers for pushing said supporting means into abutment with the opposite arm.

4. Apparatus according to claim 1, wherein said unit for removing and transferring said rows of stacks further comprises a pair of lateral walls for guiding said rows of stacks.

5. Apparatus according to claim 1, wherein said switching platform is transversely rigidly associated with said parallel and vertically movable beams.

6. Apparatus for feeding packaging machines with stacks of sheet material, comprising:

supporting means for a plurality of stacks of sheet material, said stacks being arrangeable thereon, mutually side by side, to form mutually adjacent parallel rows of stacks, said rows of stacks forming superimposed layers said layers being separated by supporting platforms;

means for centering said supporting means;

a unit for individually removing and transferring said rows of stacks;

a switching platiform for receiving said rows of stacks and transferring them;

a belt for inputting said rows of stacks, transferred by said switching platform, to the packaging machine;

locking means for retaining said supporting platforms while transferring said rows;

shredding means for shredding said supporting platforms; wherein said locking means comprises:

a shaft being supported by said unit for removing and transferring said rows; and pneumatic and mechanical grip elements being supported on said shaft; wherein said grip elements comprise:

a suction inlet; and a clamp for gripping said supporting platforms at an edge thereof.

7. Apparatus according to claim 6, wherein said supporting platforms are defined by paper sheets.

8. Apparatus according to claim 6, comprising means for eliminating said supporting platforms, wherein said means for eliminating comprises a further grip element, said further grip element being mounted on said unit for removing and transferring said rows of stacks, said further grip element being oscillable between an idle position of noninterference with the transferring of said rows of stacks and an operative position of cooperation with said grip elements for removing said supporting platform and trnasferring it to said shredding means.

9. Apparatus according to claim 6, wherein said shredding means comprises a pair of shredding rollers, said shredding rollers operating at the level of said switching platform.

10. Apparatus for feeding packaging machines with stacks of cardboard cutouts, comprising:

supporting means for a plurality of stacks of cardboard cutouts, said stacks being arranged thereon, mutually side by side, to form mutually adjacent parallel rows of stacks, said rows of stacks forming suprimposed layers, said layers being separated by supporting platforms;

means for centering said supporting means;

a unit for individually removing and transferring said rows of stacks;

a switching platform for receiving said rows of stacks and transferring them;

a belt for inputting said rows of stacks, transferred by said switching platform, to the packaging machine;

Said unit comprising a head with pusher means arranged vertically side by side for moving an individual row of stacks along a horizontal transfer direction, wherein said pusher means comprises a plurality of rods, said rods being arranged vertically side by side and comprising, at respective lower end thereof, respective sensing means and suction means for sensing and eliminating the cardboard cutouts arranged incorrectly in said stacks; and said rods being vertically moveable for entering corresponding spaces defined between tabs and indents of adjacent rows of stacks, said rods being further movable for advancing in the direction of said switching platform for pushing a single row of stacks thereon, and said switching platform being vertically movable between a first position at the level of a supporting platform and a second raised position for being coplanar to said belt for inputting said rows of stacks to the packaging machine.

11. Apparatus according t claim 10, wherein said rods have a cross section which is shaped for entering said corresponding spaces defined between said tabs and indents of adjacent rows of stacks.

12. Apparatus according to claim 10, wherein the distance between the axes of said rods is equal to the width of said cardboard cutouts.

* * * * *